US005608926A

United States Patent [19]

Donaton

[11] Patent Number: 5,608,926

[45] Date of Patent: Mar. 11, 1997

[54] SWIMMING POOL COVER LOOP-LOC FASTENER

[76] Inventor: William S. Donaton, 100 Engineers Rd., Hauppauge, N.Y. 11788

[21] Appl. No.: 497,813

[22] Filed: Jul. 3, 1995

[51] Int. Cl.[6] ..... E04H 4/00

[52] U.S. Cl. ..... 4/503; 4/498; 126/565; 126/624

[58] Field of Search ..... 4/498, 499, 503, 4/504; 126/563, 565, 566, 624

[56] References Cited

U.S. PATENT DOCUMENTS

| | | | |
|---|---|---|---|
| D. 359,224 | 6/1995 | Airey | D8/349 |
| 1,961,935 | 6/1934 | Knapp | 248/18 |
| 2,247,846 | 7/1941 | Perlman | 156/15 |
| 2,815,809 | 12/1957 | Jacobs | 160/368 |
| 2,914,776 | 12/1959 | Hotz | 4/172 |
| 2,958,872 | 11/1960 | Meyer | 4/172 |
| 3,264,656 | 8/1966 | Clay | 4/172 |
| 3,360,075 | 12/1967 | Gutner | 182/106 |
| 3,373,464 | 3/1968 | Ansnit | 24/201 |
| 3,600,721 | 8/1971 | Pusey | 4/172.12 |
| 3,676,880 | 7/1972 | Kwake | 4/503 X |
| 3,711,873 | 1/1973 | Katzman | 4/172.12 |
| 3,780,385 | 12/1973 | Dunn | 4/172.12 |
| 3,803,671 | 4/1974 | Stuppy | 24/243 K |
| 3,982,286 | 9/1976 | Foster | 4/172.14 |
| 3,987,835 | 10/1976 | Bloomfield | 160/392 |
| 4,001,900 | 1/1977 | Lamb | 4/172.14 |
| 4,011,607 | 3/1977 | Davidoff | 4/172.12 |
| 4,080,690 | 3/1978 | Vaux | 24/201 |
| 4,151,617 | 5/1979 | Kinzel | 4/172.14 |
| 4,164,047 | 8/1979 | Barothy | 4/172.11 |
| 4,195,622 | 4/1980 | Dolza | 126/415 |
| 4,387,873 | 6/1983 | Pavlo | 248/226.4 |
| 4,466,144 | 8/1984 | Lamb | 4/503 |
| 4,677,352 | 5/1987 | Leister | 4/498 |
| 4,716,603 | 1/1988 | Sernetz | 4/501 |
| 4,790,293 | 12/1988 | Caines | 126/415 |
| 4,916,763 | 4/1990 | Christensen | 4/503 |
| 4,951,327 | 8/1990 | Del Gorio | 4/498 |
| 4,953,239 | 9/1990 | Gadsby | 4/499 |
| 4,982,457 | 1/1991 | Donaton | 4/504 |
| 5,014,369 | 5/1991 | Daus | 4/503 |
| 5,065,461 | 11/1991 | Shehan | 4/503 |
| 5,067,184 | 11/1991 | Last | 4/502 |
| 5,067,213 | 11/1991 | Ragsdale | 24/704.1 |
| 5,068,929 | 12/1991 | Weiner | 4/503 |
| 5,107,551 | 4/1992 | Weir | 4/496 |
| 5,184,377 | 2/1993 | Ragsdale | 24/704.1 |
| 5,259,077 | 11/1993 | Hager | 4/498 |
| 5,282,282 | 2/1994 | Shehan | 4/503 |
| 5,303,527 | 4/1994 | Perez | 52/632 |
| 5,327,590 | 7/1994 | Last | 4/502 |
| 5,371,907 | 12/1994 | Horvath | 4/498 |
| 5,417,016 | 5/1995 | Dahowski | 52/23 |
| 5,426,899 | 6/1995 | Jones | 52/63 |
| 5,431,041 | 6/1995 | Stern | 4/498 |
| 5,450,635 | 9/1995 | Coffey | 4/498 |
| 5,516,386 | 5/1996 | Savarese | 156/210 |
| 5,546,615 | 8/1996 | Chammess | 4/503 |

*Primary Examiner*—Charles E. Phillips
*Attorney, Agent, or Firm*—Alfred M. Walker

[57] ABSTRACT

A snap hook fastener for swimming pool covers is provided to hold a pool cover edge rigidly close to the edge of the pool. The snap hook/eyebolt connection supports a pool edge sealing member in a proper orientation for optimal contact with the pool wall. The fastener includes a hook device used to attach the pool cover to the edge of a pool. It holds the edge of the pool cover horizontal and very close to the edge of the pool to minimize the chance of persons or objects falling between.

3 Claims, 7 Drawing Sheets

SWIMMING POOL COVER LOOP-LOC FASTENER

FIELD OF THE INVENTION

The present invention relates to a snap hook fastener for swimming pool covers.

BACKGROUND OF THE INVENTION

Ordinary snap hooks have been used to attach pool covers to an eye bolt at the edge of a pool wall, but even if the edge of the pool cover itself extends over the snap hook and eyebolt, the cover edge is not rigidly held close to the edge of the pool and therefore it droops undesirably. Furthermore, if the edge of the pool cover has an attached "Safedge®" flexible seal device, to prevent the falling of persons between the pool cover and the pool wall, such as described in Applicant's prior U.S. Pat. No. 4,982,457, the ordinary snap hook/eyebolt connection is not ideally suited to support it in a proper orientation for optimal contact with the pool wall.

OBJECTS OF THE INVENTION

The present invention includes a hook device used to attach a pool cover to the edge of a pool. It is therefore an object of the present invention to hold the edge of the pool cover horizontal and very close to the edge of the pool to minimize the chance of persons or objects falling between. A further objective of this invention is to optimally support the aforesaid "Safedge®" pool cover seal device, which is attached to the edge of the pool cover.

SUMMARY OF THE INVENTION

In keeping with these objects and others which may become apparent, the present invention includes a snap hook attached to a member which includes an open loop attachable to a preformed loop of the pool cover fabric. The open loop extends a predetermined distance upon the member corresponding to the opposite horizontally extending portion of an eyebolt from a pool wall, so that the edge of the pool cover is nearly adjacent to the pool wall thereby minimizing the chance of a person falling in a gap between the pool cover edge and the vertical pool wall.

DESCRIPTION OF THE DRAWINGS

The present invention can best be understood in connection with the accompanying drawings, in which.

DETAILED DESCRIPTION OF THE DRAWINGS

Figure 1:
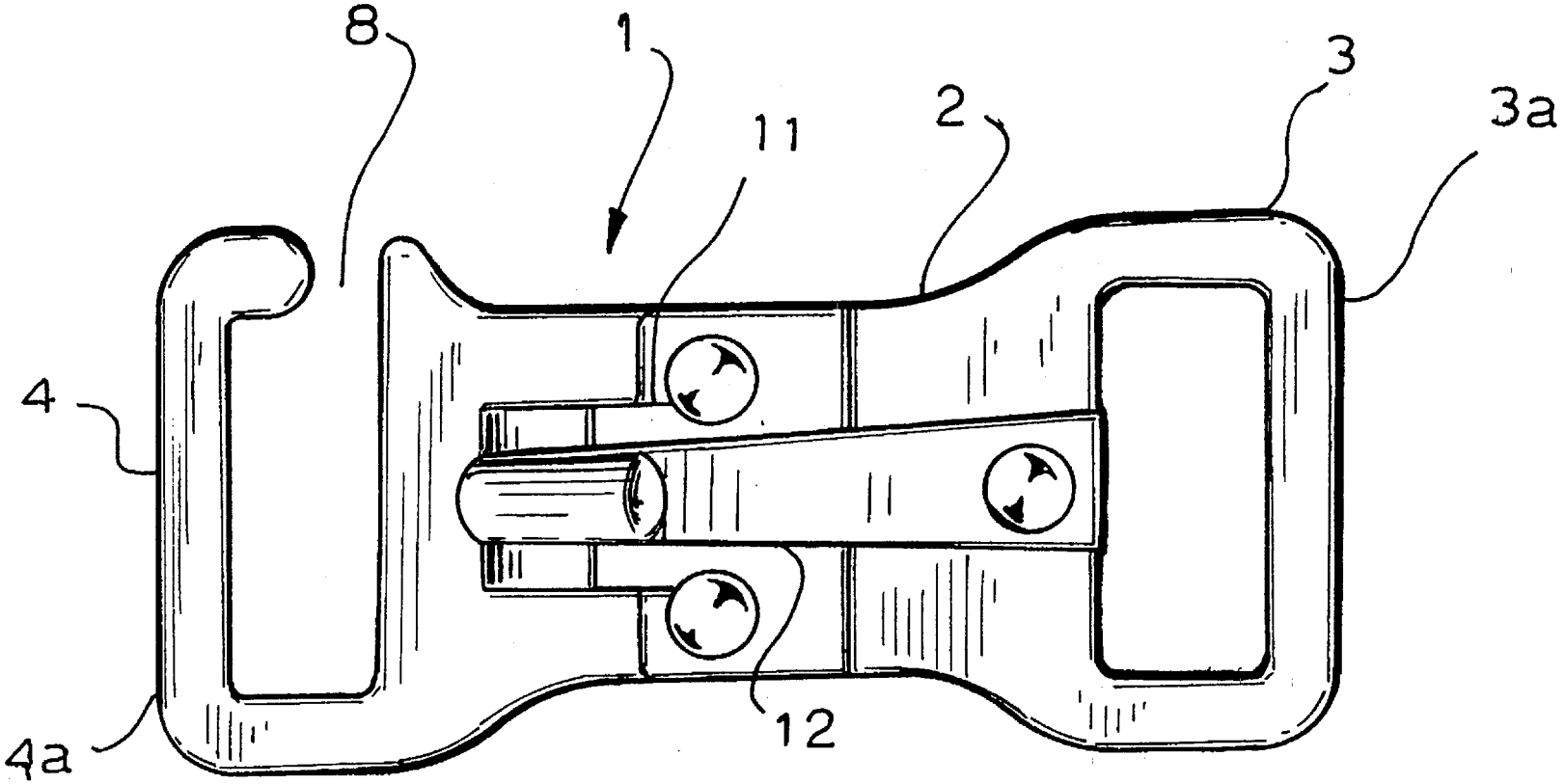
FIG. 1 is a top view of the swimming pool cover snap hook of the present invention.

As shown in FIG. 1, the snap hook 1 includes a generally flat base chassis member 2 having two loops 3,4 at opposite ends 3*a*, 4*a*.

One loop 3 at end 3*a* is a rigid closed attachment loop which is used to attach snap hook 1 to pool cover 5 via a fabric fastener 14 with fabric layers 6, 7 forming a loop of webbing attached beneath pool cover 5.

At the other end 4*a* of the snap hook 1 is a rigid loop 4 with a gap 8 or opening to permit attachment of the snap hook 1 to a preformed pool fabric attachment loop 9 by sliding it in sideways.

Figure 2:
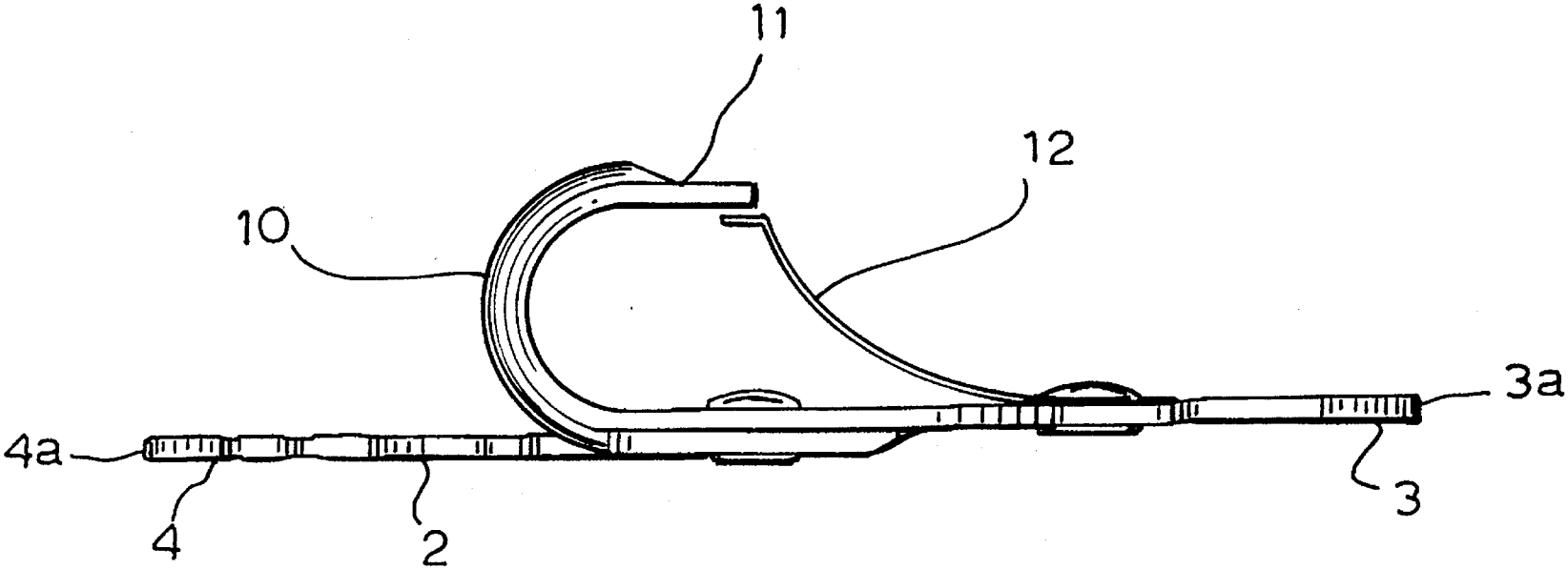
FIG. 2 is a side view thereof.

FIG. 2 shows the eyebolt loop 10 and the spring locking member 11 or tongue, which gives the device of the present invention the name of "snap hook" since the eyebolt 10*a* is just snapped in past the spring 12, into hook member 11.

Figure 3:
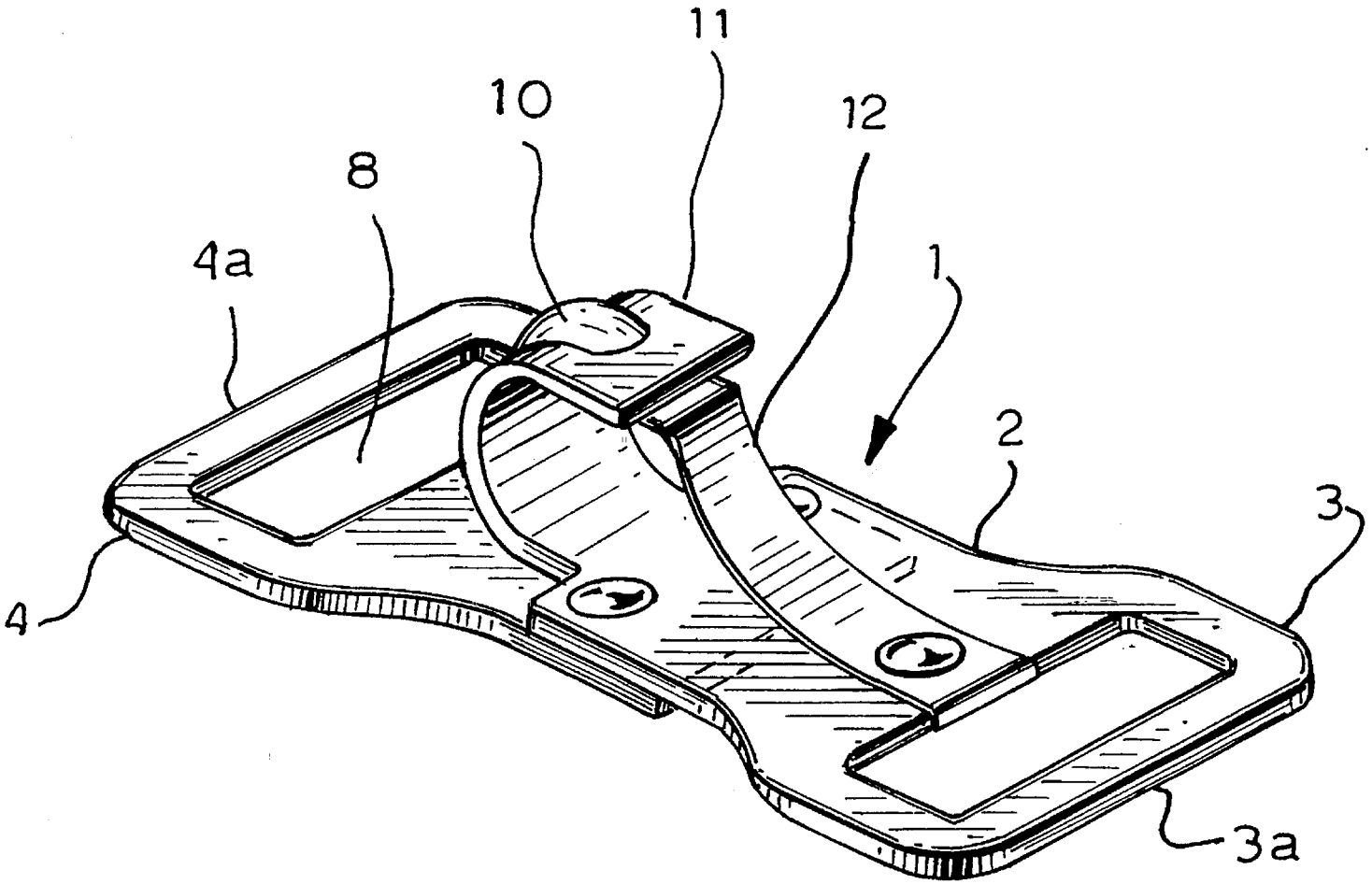
FIG. 3 is an isometric view thereof.

FIG. 3 shows the geometric arrangement of the major parts of the snap hook 1 when assembled.

Figure 4:
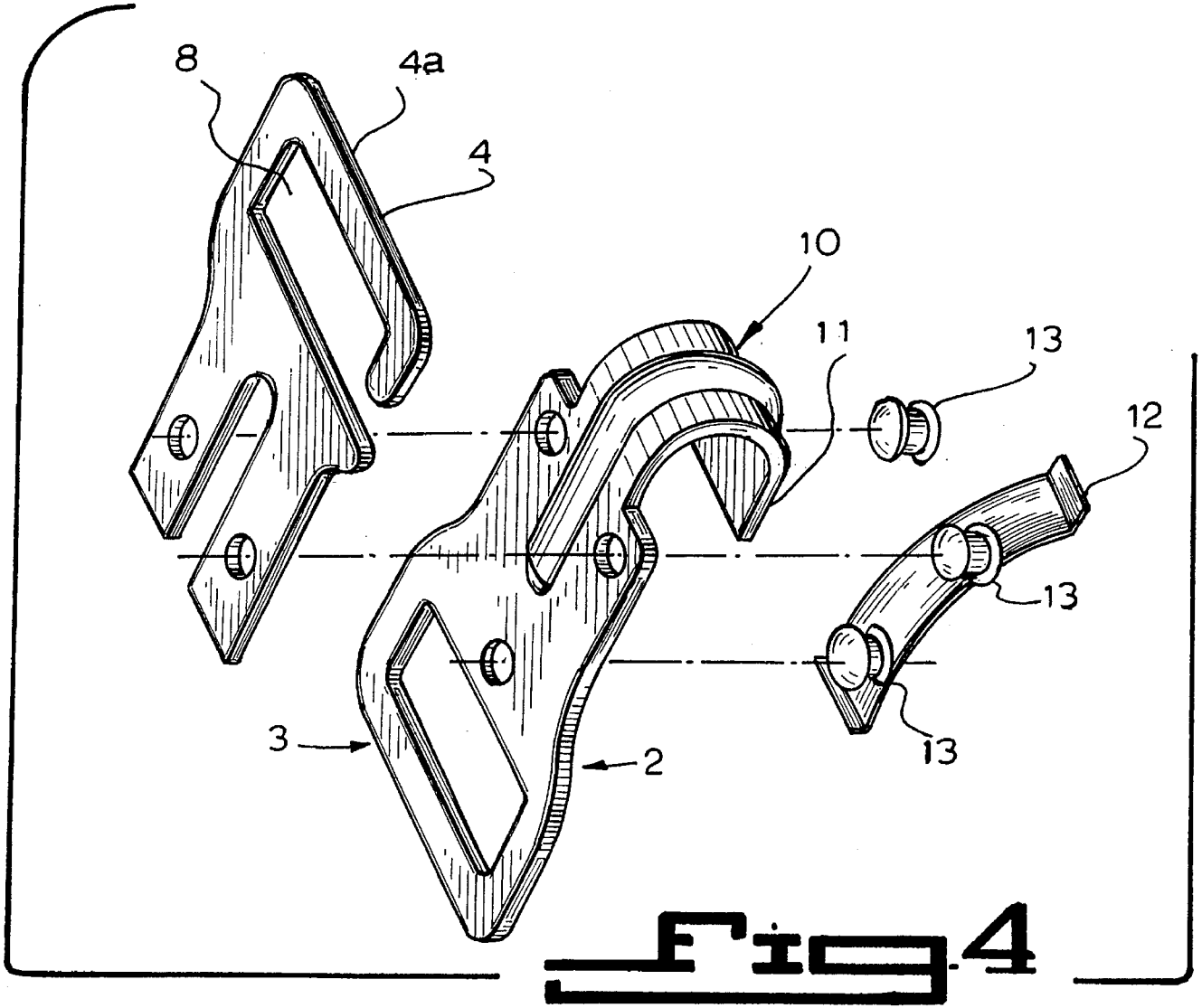
FIG. 4 is an exploded view of the parts of the swimming pool cover snap hook as in FIG. 1.

FIG. 4 shows the various snap hook parts and the method of assembly through the use of three rivets 13. Although other suitable materials may be appropriate, the snap hook chassis member 2 and edge loop extensions 3, 4 are preferably made of 302 annealed stainless steel while the spring 12 is preferably 301/302 spring tempered stainless steel, and the rivets 13 are preferably 305 stainless steel. The assembly is preferably passivated to enhance corrosion resistance. The eyebolt loop 10 has a reinforcing ridge to resist straightening. The open edge loop extension 4 is a flat stamping which is riveted to the chassis member.

Figure 5:
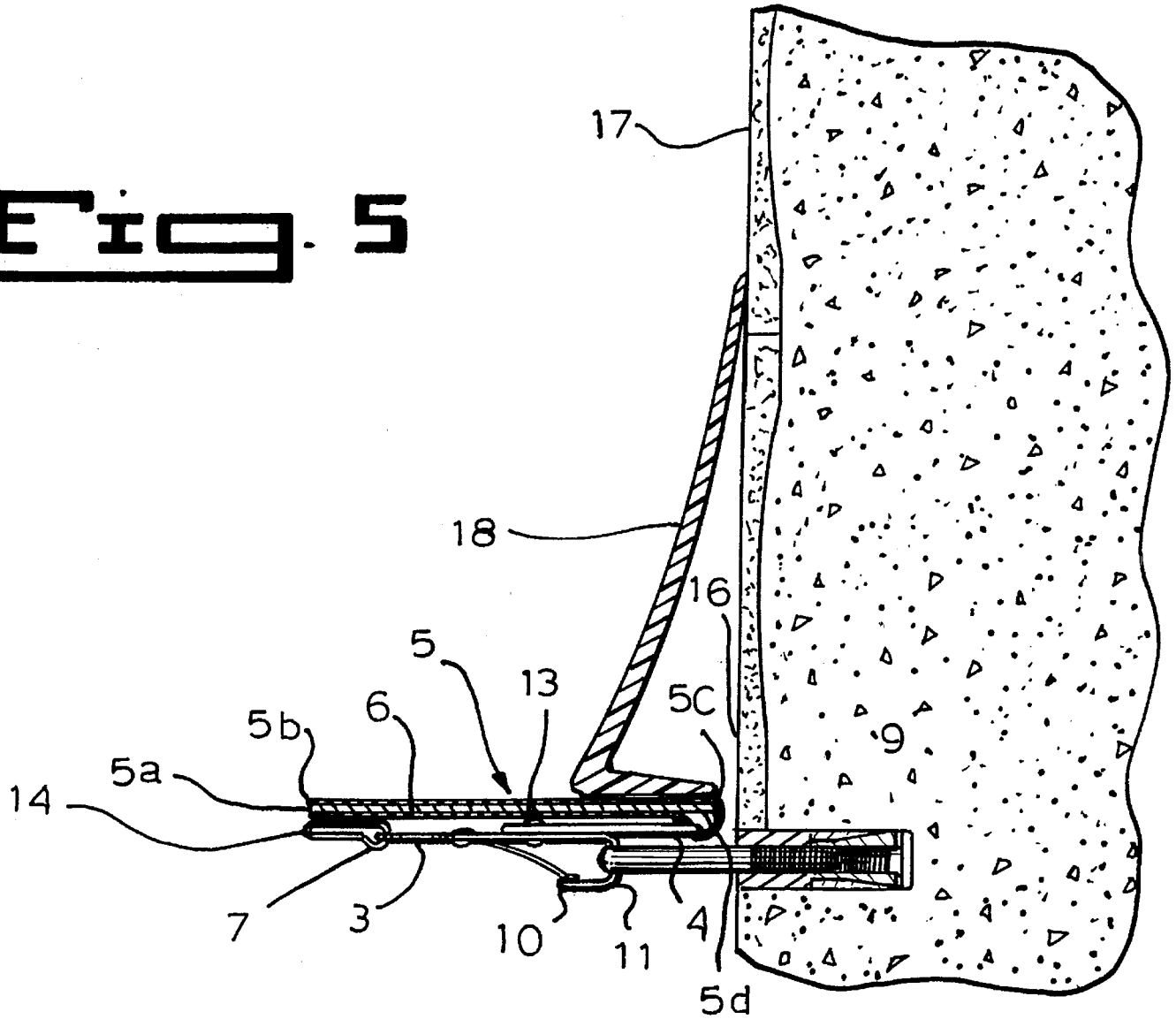
FIG. 5 is a side elevational view of the snap hook/eyebolt bolt connection.
Figure 6:
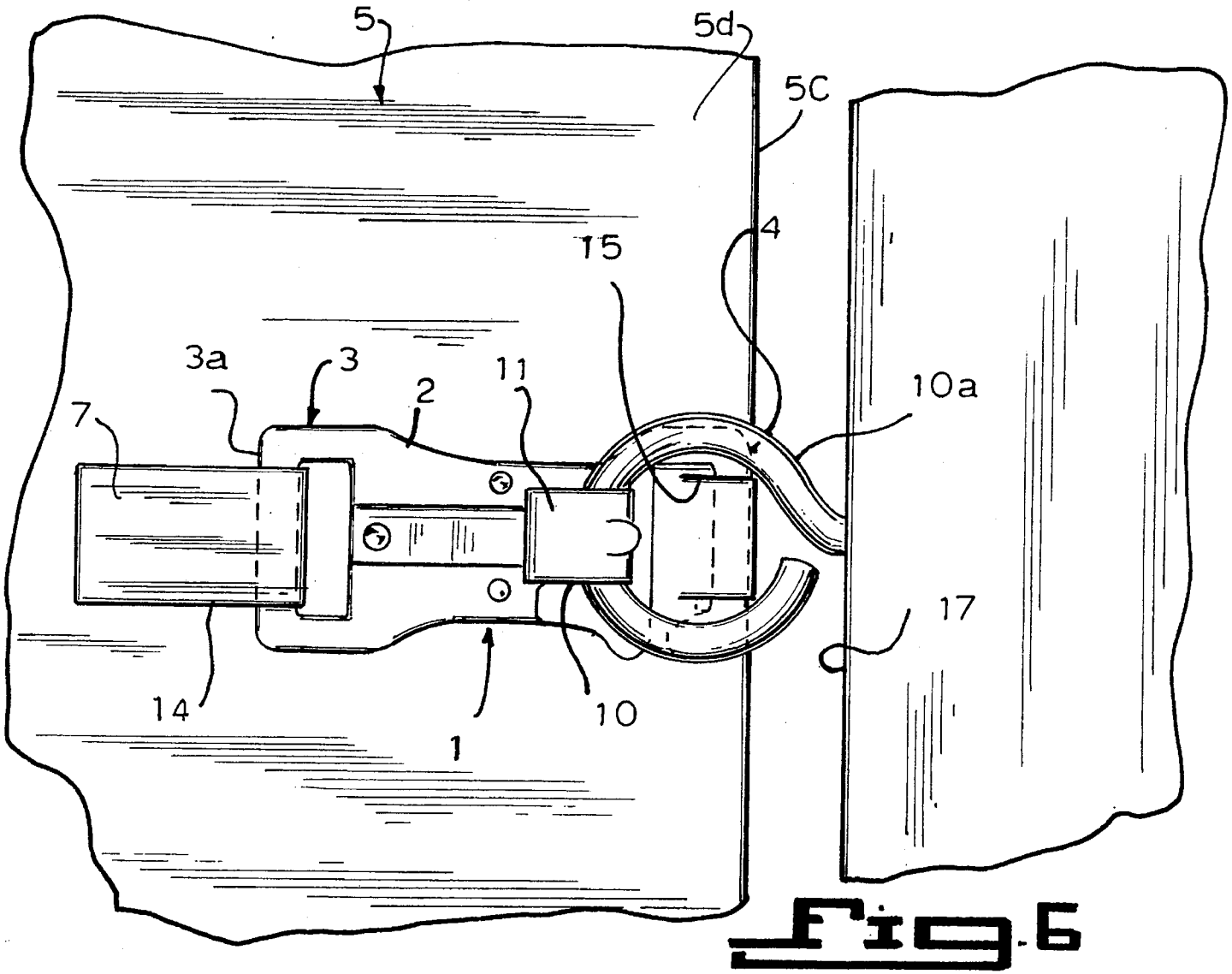
FIG. 6 is a bottom view of the snap hook as in FIG. 1, shown in connection with an eye bolt; and, FIG. 7 is a bottom view of an alternate embodiment for a snap hook in connection with an eye bolt, showing use of a separate edge fabric loop strap.

The installation operation of the snap hook 1 of the present invention is illustrated in FIGS. 5 and 6. In FIG. 5, two fabric substrate layers 6, 7 form double webbing fastener 14 attached under pool cover 5. The double webbing fastener 14 of pool cover 5 is shown looped through the closed attachment loop 3 at the left end of the snap hook 1. This can be seen more clearly in the bottom view of FIG. 6. The fabric webbing fastener 14 and closed loop 3 withstand the full tension of the attachment. The eyebolt 10 is shown in both views engaging the eyebolt hook 11 on the snap hook 1.

As shown in FIG. 5, the pool cover 5 is shown in crossection as having a core material 5*a* covered with another outer layer 5*b* which goes around the edge 5*c* and continues to cover the bottom side 5*d*. In the vicinity of hook 11, this outer layer 5*b* forms a fabric loop through which the open edge loop member 4 of the snap hook 1 is inserted.

In FIG. 6, two slits 15, 15*a* are shown in the bottom of the pool cover 5 which permit the fabric loop to be formed.

The snap hook 1 gives stability to the edge of the pool cover 5, holding it essentially horizontal and closely adjacent to the edge wall 16 of the pool 17 by virtue of the edge loop extension 4 portion and its edge loop member engagement in the edge fabric loop 9, as well as the tension of the wall attachment.

As shown in FIG. 5, this is also the optimal orientation of the pool cover edge for the engagement of "Safedge®" flexible seal member 18 with the pool edge wall 16 of pool 17.

Figure 7:
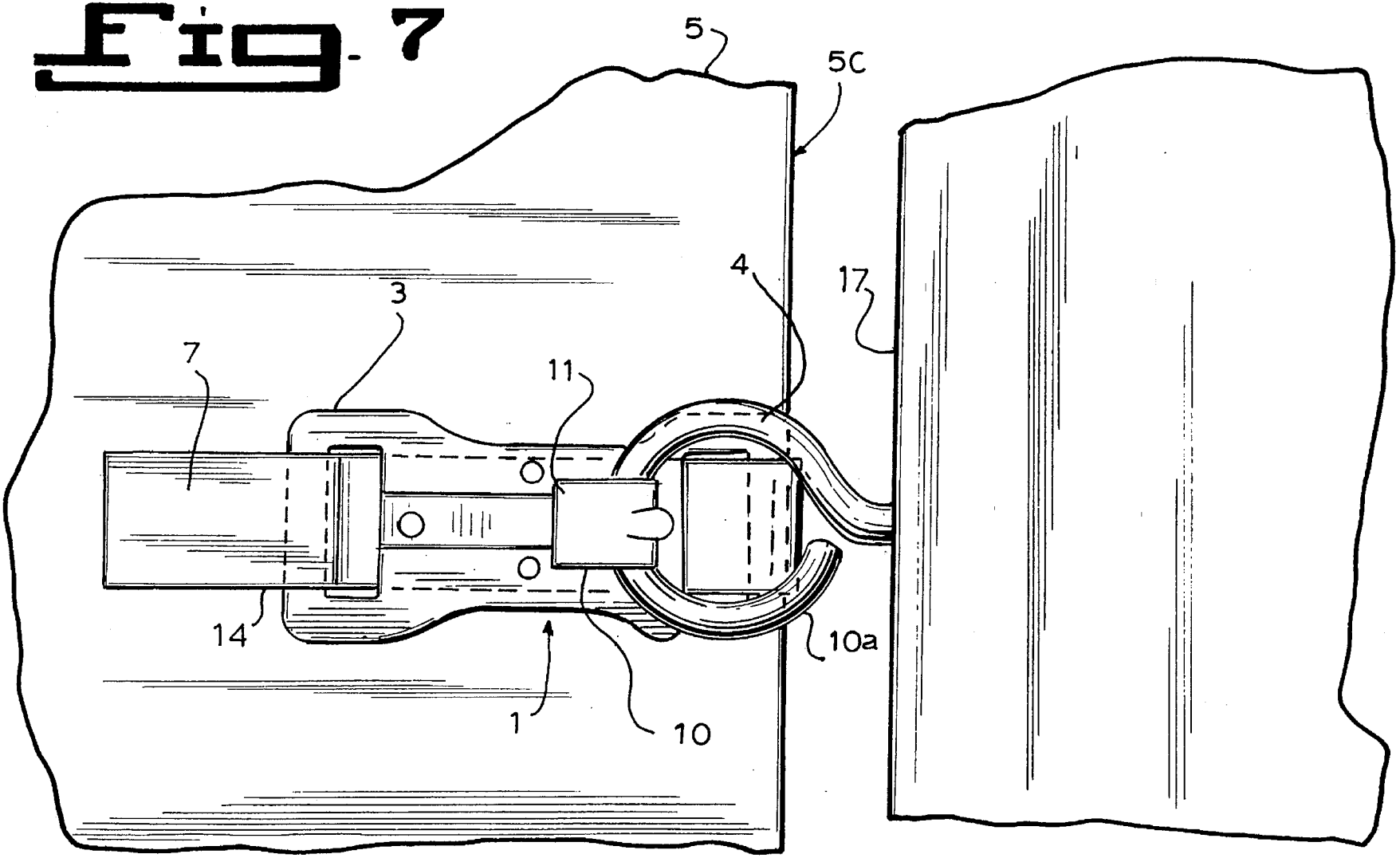

As shown in FIG. 7, the edge fabric loop shown in crossection in FIG. 5 can also alternatively represent a separate strap 19 of web material which is looped around the edge 5*c* of the pool cover 5 and attached to the pool cover 5 itself. FIG. 7 shows this alternate construction. As shown in FIG. 5, a small portion of the strap 19 is left unattached to the underside of the pool cover 5 near the edge forming a fabric loop. FIG. 7 shows the strap loop 19 being engaged by the edge loop member 4 of the snap hook 1. The strap continues under the snap hook body 1 and beyond under the double webbing fabric loop. The operation and benefits of this construction are identical to those descriptions of the multi-layered pool cover construction without the separate edge fabric loop strap.

It is noted that other modifications may be made to the present invention, without departing from the scope of the present invention, as noted in the appended claims.

I claim:

1. A combination swimming pool cover and pool wall fastener, said cover attachable to a wall of a swimming pool;

said fastener comprising a longitudinally extending base chassis member having at each end thereof a loop of a pair of first and second loops, said first loop being an open loop engaged with a pre-formed fabric loop fastener portion attached to said pool cover, said second loop being a closed loop engaged with a further fastener portion of said pool cover, said fastener further comprising a hook member engagable with a fastener extending from the wall of the swimming pool, said pool cover having a core material covered with further fabric outer layer, said further fabric outer layer extending around an edge of said pool cover and continuing to cover a bottom side of said pool cover, said further fabric outer layer forming said fabric loop through which said open loop member of said chassis member is insertable.

2. The snap hook fastener as in claim 1 wherein said first pool cover fastener loop comprises a plurality of substrate layers attached to said pool cover at an underside thereof.

3. The snap hook fastener as in claim 1 wherein said hook member further comprises a flexible spring engagable with an open gap of said hook member.

* * * * *